US012799610B2

(12) United States Patent
Shimizu

(10) Patent No.: US 12,799,610 B2
(45) Date of Patent: Nov. 17, 2026

(54) ELECTROCHEMICAL STACK

(71) Applicant: HONDA MOTOR CO., LTD., Tokyo (JP)

(72) Inventor: Ko Shimizu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 56 days.

(21) Appl. No.: 19/028,089

(22) Filed: Jan. 17, 2025

(65) Prior Publication Data

US 2025/0277319 A1 Sep. 4, 2025

(30) Foreign Application Priority Data

Feb. 29, 2024 (JP) ..... 2024-029405

(51) Int. Cl.
*C25B 9/00* (2021.01)
*C25B 9/70* (2021.01)

(52) U.S. Cl.
CPC ..... *C25B 9/70* (2021.01)

(58) Field of Classification Search
CPC ..... C25B 9/70; C25B 9/00
See application file for complete search history.

(56) References Cited

U.S. PATENT DOCUMENTS

| | | | |
|---|---|---|---|
| 2015/0030949 | A1 | 1/2015 | Ishikawa et al. |
| 2015/0255810 | A1 | 9/2015 | Kells et al. |
| 2019/0218676 | A1 | 7/2019 | Noda et al. |
| 2020/0095695 | A1 | 3/2020 | Holler |

FOREIGN PATENT DOCUMENTS

| | | | |
|---|---|---|---|
| CN | 106058372 | A | 10/2016 |
| CN | 216648424 | U | 5/2022 |
| DE | 10 2022 116 071 | A1 | 12/2023 |
| JP | S61186169 | U | 11/1986 |
| JP | H04-181657 | A | 6/1992 |
| JP | 2011-021212 | A | 2/2011 |
| JP | 2013-058373 | A | 3/2013 |
| JP | 2015-531980 | A | 11/2015 |
| JP | 2017-188224 | A | 10/2017 |
| JP | 2019-123899 | A | 7/2019 |
| JP | 7390892 | B2 | 12/2023 |
| WO | 2013/065757 | A1 | 5/2013 |

OTHER PUBLICATIONS

Office Action and Search Report dated Nov. 21, 2025 issued in the corresponding Chinese Patent Application No. 202510195397.2 with the English machine translation thereof.

*Primary Examiner* — Zulmariam Mendez
(74) *Attorney, Agent, or Firm* — Carrier, Shende & Associates P.C.; Joseph P. Carrier; Jeffrey T. Gedeon

(57) ABSTRACT

An electrochemical stack includes a water passage member interposed between two electrochemical cells among a plurality of electrochemical cells, the two electrochemical cells being located in a central region in a stacking direction of the electrochemical cells. The water passage member is provided with a water introduction unit and a flow path. The water introduction unit introduces water supplied from the outside. The flow path allows water introduced from the water introduction unit to flow along the electrochemical cells and guides the water to a water introducing communication passage penetrating the plurality of electrochemical cells in the stacking direction of the electrochemical cells.

6 Claims, 10 Drawing Sheets

ELECTROCHEMICAL STACK

CROSS-REFERENCE TO RELATED APPLICATIONS

This application is based upon and claims the benefit of priority from Japanese Patent Application No. 2024-029405 filed on Feb. 29, 2024, the contents of which are incorporated herein by reference.

BACKGROUND OF THE INVENTION

Field of the Invention

The present disclosure relates to an electrochemical stack.

Description of the Related Art

There are electrochemical stacks including stacked electrochemical cells. Examples of the electrochemical stack include a water electrolysis stack, a hydrogen compression stack (an electrochemical hydrogen pump stack), and a fuel cell stack. In the water electrolysis stack, a plurality of water electrolysis cells are stacked. In the hydrogen compression stack, hydrogen compression cells are stacked. In the fuel cell stack, a plurality of unit cells are stacked.

JP 2019-123899 A discloses a water electrolysis system including a water electrolysis stack. In this water electrolysis system, water is circulated so that water stored in the gas-liquid separator is supplied into the water electrolysis stack, and unreacted water that has not been electrolyzed in the water electrolysis stack is discharged to the gas-liquid separator. The water supplied into the water electrolysis stack is supplied to each of the plurality of water electrolysis cells. Unreacted water that has not been electrolyzed in each of the plurality of water electrolysis cells is supplied from the water electrolysis stack to the gas-liquid separator.

SUMMARY OF THE INVENTION

The electrochemical stack generates heat during operation, and thus the temperature of the electrochemical stack increases. The temperature distribution within the electrochemical stack is not uniform and varies. The progress of deterioration of the electrolyte membranes provided in the electrochemical cells having a relatively high temperature tends to be faster than the progress of deterioration of the electrolyte membranes provided in the electrochemical cells having a relatively low temperature. Therefore, it has been desired to cool the electrochemical cells having a relatively high temperature.

The present invention has the object of solving the aforementioned problem.

An aspect of the present disclosure is an electrochemical stack comprising: a plurality of electrochemical cells stacked on one another; a water introduction unit configured to introduce water supplied from an outside; a water lead-out unit configured to lead out the water to the outside; a water introducing communication passage penetrating the plurality of electrochemical cells along a stacking direction of the electrochemical cells, and configured to guide the water to a first port provided in each of the plurality of electrochemical cells; a water lead-out communication passage penetrating the plurality of electrochemical cells along the stacking direction, and configured to guide, to the water lead-out unit, the water discharged from a second port provided in each of the plurality of electrochemical cells; and a water passage member interposed between two of the plurality of electrochemical cells, the two electrochemical cells being located in a central region in the stacking direction, wherein the water passage member is provided with the water introduction unit, and a flow path through which an entire amount of the water introduced from the water introduction unit flows along the electrochemical cells and is guided to the water introducing communication passage.

According to the aspect of the present disclosure, it is possible to increase the degree of cooling of the electrochemical cells in the end regions, and the electrochemical cells in the central region which have a relatively high temperature.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

First Embodiment

Figure 1:
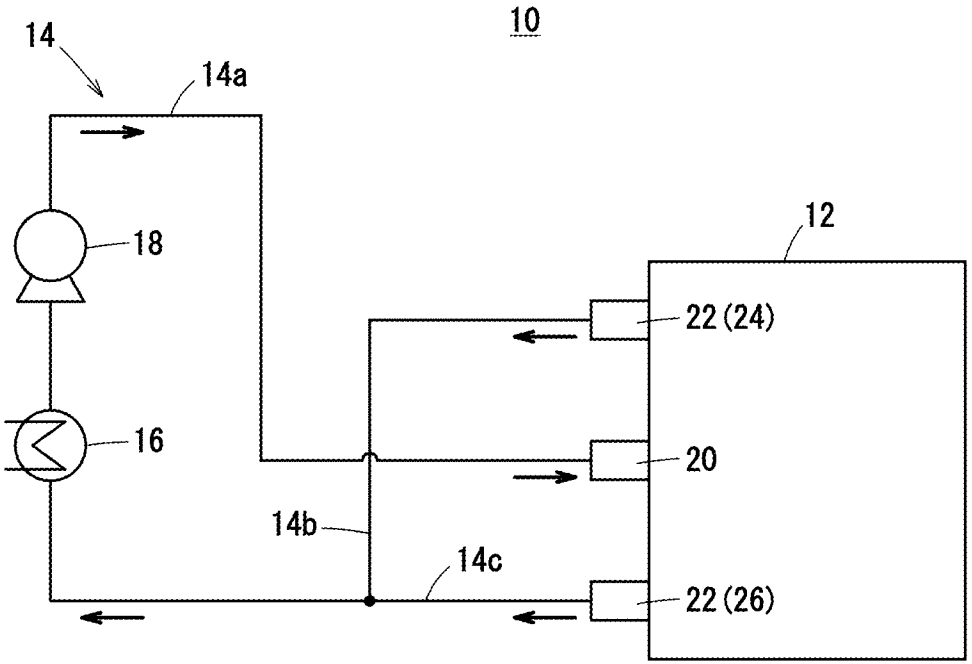
FIG. 1 is a diagram showing a water supply system according to a first embodiment.

FIG. 1 is a diagram showing a water supply system 10 according to the first embodiment. The water supply system 10 includes an electrochemical stack 12, a water circulation flow path 14, a heat exchanger 16, and a circulation pump 18.

The electrochemical stack 12 is a stack capable of performing an electrochemical reaction. The electrochemical stack 12 may be a water electrolysis stack capable of electrolyzing water. Alternatively, the electrochemical stack 12 may be a hydrogen compression stack (an electrochemical hydrogen pump stack) capable of electrolyzing hydrogen (hydrogen gas). Alternatively, the electrochemical stack 12 may be a fuel cell stack capable of performing an electrochemical reaction between hydrogen (hydrogen gas) and oxygen (oxygen gas). The electrochemical stack 12 is formed in a substantially cylindrical shape, for example.

The electrochemical stack 12 is provided with a water introduction unit 20 for introducing water from the outside, and a water lead-out unit 22 for leading out the water introduced from the water introduction unit 20. The water lead-out unit 22 includes a first water lead-out unit 24 and a second water lead-out unit 26.

The water circulation flow path 14 is a channel for allowing water to flow through the electrochemical stack 12. The water circulation flow path 14 is connected to the electrochemical stack 12. The water circulation flow path 14 includes a first flow path portion 14*a*, a second flow path portion 14*b*, and a third flow path portion 14*c*. The first flow path portion 14*a* connects the water introduction unit 20 and the circulation pump 18. The second flow path portion 14*b* connects the first water lead-out unit 24 and the circulation pump 18. The third flow path portion 14*c* connects the second water lead-out unit 26 and the second flow path portion 14*b*. The third flow path portion 14*c* may connect the second water lead-out unit 26 and the circulation pump 18. In this case, the second flow path portion 14*b* connects the first water lead-out unit 24 and the third flow path portion 14*c*.

The heat exchanger 16 is provided at a portion between the circulation pump 18 and a connecting portion between the second flow path portion 14*b* and the third flow path portion 14*c* of the water circulation flow path 14. The heat exchanger 16 cools water that is heated by heat generated in the electrochemical stack 12. The heat exchanger 16 may be a radiator.

The circulation pump 18 circulates water between the heat exchanger 16 and the electrochemical stack 12 through the water circulation flow path 14.

Figure 2:
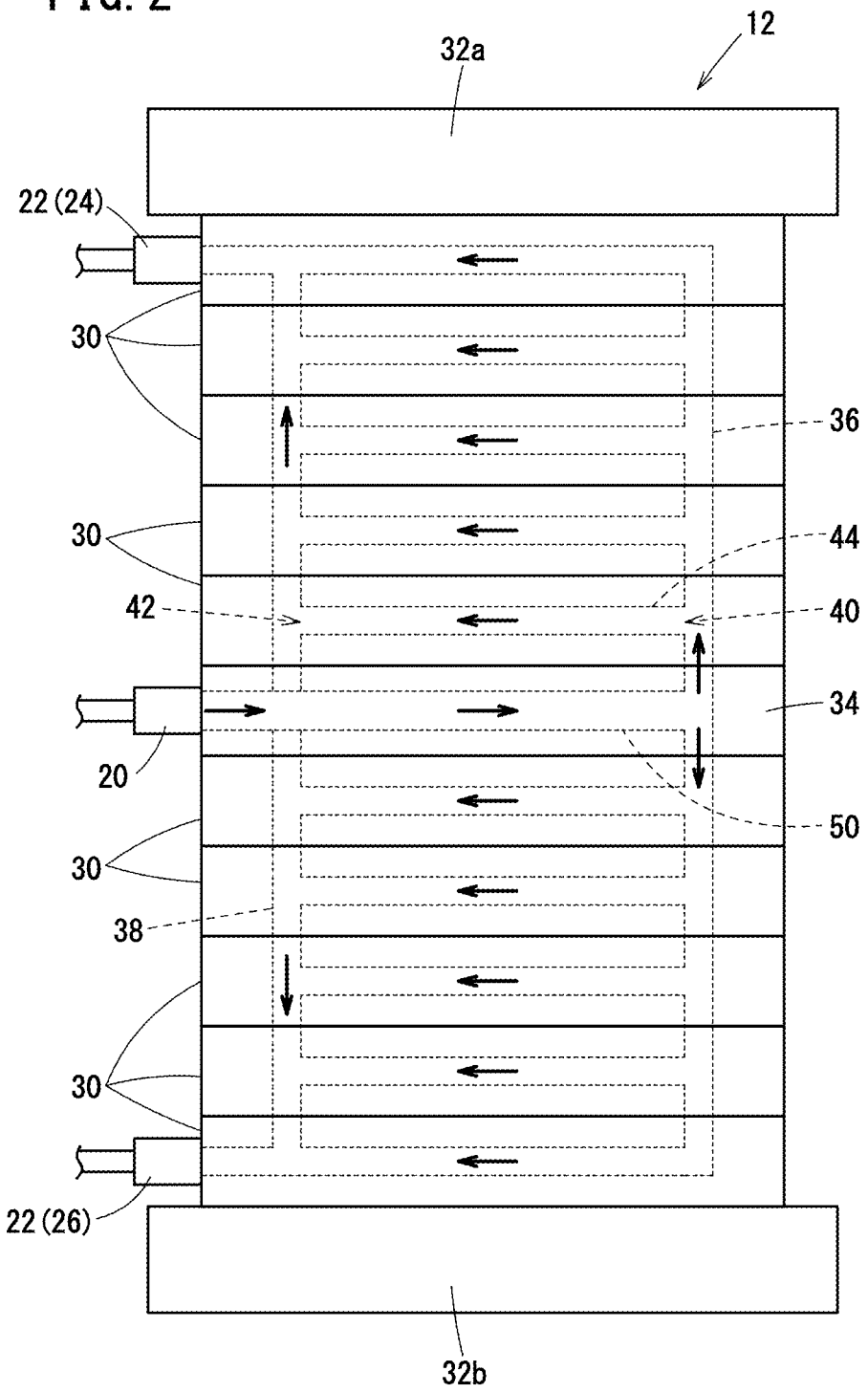
FIG. 2 is a schematic diagram showing an electrochemical stack according to the first embodiment.

FIG. 2 is a schematic diagram showing the electrochemical stack 12 according to the first embodiment. The electrochemical stack 12 includes a plurality of electrochemical cells 30, end plates 32*a* and 32*b*, a water passage member 34, a water introducing communication passage 36, and a water lead-out communication passage 38.

The plurality of electrochemical cells 30 are stacked between the end plates 32*a* and 32*b*. The end plate 32*a* is a plate that constitutes one end of the electrochemical stack 12 in the stacking direction of the electrochemical cells 30. The end plate 32*b* is a plate that constitutes the other end of the electrochemical stack 12 in the stacking direction of the electrochemical cells 30.

The electrochemical cell 30 may be a water electrolysis cell capable of electrolyzing water. Alternatively, the electrochemical cell 30 may be a hydrogen compression cell (an electrochemical hydrogen pump cell) capable of electrolyzing hydrogen. Alternatively, the electrochemical cell 30 may be a unit cell capable of performing an electrochemical reaction between hydrogen and oxygen.

Although not shown in detail, a membrane electrode assembly is provided in each of the plurality of electrochemical cells 30. The membrane electrode assembly includes an electrolyte membrane, and an anode current collector (an anode) and a cathode current collector (a cathode) disposed on both sides of the electrolyte membrane in the thickness direction thereof.

Each of the plurality of electrochemical cells 30 is provided with a first port 40, a second port 42, and a water supply path 44. The first port 40 is connected to the water introducing communication passage 36. The first port 40 is located on the opposite side to the water introduction unit 20 in a direction intersecting (an orthogonal direction to) the stacking direction of the electrochemical cells 30. More specifically, the first port 40 is provided at a position shifted in phase by 180° in the circumferential direction of the electrochemical stack 12 from the water introduction unit 20. The second port 42 is connected to the water lead-out communication passage 38. The second port 42 is located on the opposite side to the first port 40 in the direction intersecting (the orthogonal direction to) the stacking direction of the electrochemical cells 30. The water supply path 44 connects the first port 40 and the second port 42. The water supply path 44 extends along the direction intersecting (the orthogonal direction to) the stacking direction of the electrochemical cells 30. The number of the water supply paths 44 may be one or more.

The water passage member 34 is interposed between two electrochemical cells 30 located in a central region in the stacking direction, among the plurality of electrochemical cells 30. No other electrochemical cell 30 is interposed between the two electrochemical cells 30 between which the water passage member 34 is interposed. The central region is, for example, a middle region obtained by dividing the plurality of electrochemical cells 30 into three equal parts in the stacking direction. The regions on the outer side in the stacking direction may be referred to as end regions. However, the central region may be, for example, a middle region obtained by dividing the plurality of electrochemical cells 30 into three parts at a ratio of 1:2:1 in the stacking direction.

In the present embodiment, the water passage member 34 is interposed between the electrochemical cell 30 located at one end in the stacking direction among the plurality of electrochemical cells 30, and the electrochemical cell 30 located at the other end in the stacking direction among the plurality of electrochemical cells 30, but the present invention is not limited thereto. Further, the water passage member 34 is formed in a plate shape (specifically, a disk shape), but the shape is not limited thereto.

Unlike the electrochemical cell 30, the water passage member 34 does not include a membrane electrode assembly. Therefore, unlike the electrochemical cell 30, electricity is not supplied to the water passage member 34. The water passage member 34 is provided with the water introduction unit 20 and a flow path 50. One end of the flow path 50 is connected to the water introduction unit 20. The other end of the flow path 50 is connected to the water introducing communication passage 36. The flow path 50 extends along the direction in which the water supply path 44 extends. The flow path 50 has a flow cross-sectional area larger than the flow cross-sectional area of the water supply path 44 of each of the plurality of electrochemical cells 30, but the present invention is not limited thereto. The flow path 50 allows water introduced from the water introduction unit 20 to flow along the electrochemical cells 30 and guides the water to the water introducing communication passage 36. The flow path 50 may be a groove formed in the water passage member 34. In this case, the groove is sandwiched between two electrochemical cells 30, thereby forming the flow path 50.

The water introducing communication passage 36 extends along the stacking direction of the electrochemical cells 30, and penetrates the plurality of electrochemical cells 30 and the water passage member 34 in the stacking direction. In other words, the water introducing communication passage 36 communicates with the flow path 50. The water introducing communication passage 36 is disposed in the vicinity of the first port 40 of each of the plurality of electrochemical cells 30, and guides water supplied from the flow path 50 to the first port 40 of each of the plurality of electrochemical cells 30. That is, the water introducing communication passage 36 communicates with the first port 40 of each of the plurality of electrochemical cells 30 and the flow path 50.

The water lead-out communication passage 38 extends along the stacking direction of the electrochemical cells 30, and penetrates the plurality of electrochemical cells 30 in the stacking direction. The water lead-out communication passage 38 communicates with the second port 42 of each of the plurality of electrochemical cells 30, but does not communicate with the flow path 50. It should be noted that the water lead-out communication passage 38 may penetrate the water passage member 34 as long as the water lead-out communication passage 38 does not communicate with the flow path 50. The water lead-out communication passage 38 is disposed in the vicinity of the second port 42 of each of the electrochemical cells 30, and guides water discharged from the second port 42 of each of the electrochemical cells 30 to the water lead-out unit 22 (the first water lead-out unit 24 and the second water lead-out unit 26). The first water lead-out unit 24 is provided in the electrochemical cell 30 located at one end in the stacking direction, among the plurality of electrochemical cells 30. The second water lead-out unit 26 is provided in the electrochemical cell 30 located at the other end in the stacking direction, among the plurality of electrochemical cells 30.

In the water supply system 10 configured as described above, the circulation pump 18 is driven during the operation of the electrochemical stack 12. Water is circulated as follows in accordance with the driving of the circulation pump 18.

As shown in FIG. 1, the water output from the circulation pump 18 is supplied to the water introduction unit 20 (into the electrochemical cell 30 located at substantially the center in the stacking direction of the electrochemical cells 30) through the first flow path portion 14*a*. As shown in FIG. 2, the water supplied to the water introduction unit 20 flows through the flow path 50 of the water passage member 34. The water flowing through the flow path 50 passes between the two electrochemical cells 30 located in the central region in the stacking direction of the electrochemical cells 30, and flows into the water introducing communication passage 36. The water that has flowed into the water introducing communication passage 36 flows in the stacking direction of the electrochemical cells 30, and reaches the first port 40 of each of the plurality of electrochemical cells 30. The water that has reached the first port 40 flows out from the second port 42 into the water lead-out communication passage 38 through the water supply path 44. The water that has flowed out into the water lead-out communication passage 38 flows in the stacking direction of the electrochemical cells 30, and reaches the first water lead-out unit 24 or the second water lead-out unit 26. As shown in FIG. 1, the water that has reached the first water lead-out unit 24 is supplied to the circulation pump 18 through the second flow path portion 14*b*. On the other hand, the water that has reached the second water lead-out unit 26 flows into the second flow path portion 14*b* through the third flow path portion 14*c*, and is supplied to the circulation pump 18.

In response to the operation of the electrochemical stack 12, the temperature of the electrochemical stack 12 increases. It has been found that, in the electrochemical stack 12, the temperature of the electrochemical cells 30 increases as the electrochemical cells 30 are located closer to the middle in the stacking direction. This is because the electrochemical cells 30 located in the middle are less likely to dissipate heat than the electrochemical cells 30 located at the ends.

The electrochemical stack 12 of the present embodiment is provided with the water passage member 34. The water passage member 34 is interposed between two electrochemical cells 30 located in the central region in the stacking direction of the electrochemical cells 30, among the plurality of electrochemical cells 30. The water passage member 34 is provided with the flow path 50 for allowing water supplied from the outside to flow along the electrochemical cells 30 and guiding the water to the water introducing communication passage 36. Therefore, the water supplied from the outside can be distributed and supplied to each of the plurality of electrochemical cells 30 after the entire amount of the water is passed between the electrochemical cells 30 located in the central region, which have a relatively high temperature. As a result, the amount of water flowing through the flow path 50 is larger than the amount of water flowing through each of the electrochemical cells 30, and it is possible to increase the degree of cooling of the electrochemical cells 30 located in the central region, which have a relatively high temperature.

Further, in the present embodiment, in a case where water is distributed to each of the plurality of electrochemical cells 30 through the first port 40 of each of the electrochemical cells 30 communicating with the water introducing communication passage 36, the first port 40 is located on the opposite side to the water introduction unit 20 for introducing the water supplied from the outside (see FIG. 2). Therefore, it is easy to increase the distance for water to pass between the electrochemical cells 30 having a relatively high temperature.

Further, in the present embodiment, the flow path 50 has a flow cross-sectional area larger than the flow cross-sectional area of the water supply path 44 provided in each of the electrochemical cells 30. Therefore, compared to a case where the cross-sectional area of the flow path 50 is equal to or less than the cross-sectional area of the water supply path 44, the degree of cooling of the electrochemical cells 30 in the central region is easily increased. In particular, when viewed from the stacking direction, the flow cross-sectional area of the flow path 50 is preferably larger than the flow cross-sectional area of the water supply path 44.

Furthermore, in the present embodiment, the water passage member 34 is interposed between the electrochemical cell 30 located at one end in the stacking direction of the electrochemical cells 30 among the plurality of electrochemical cells 30, and the electrochemical cell 30 located at the other end in the stacking direction of the electrochemical cells 30 among the plurality of electrochemical cells 30, in other words, between the electrochemical cells 30 in the end regions. Therefore, compared to a case where the water passage member 34 is interposed between other two electrochemical cells 30, the degree of cooling of the electrochemical cells 30 in the central region is easily increased.

Second Embodiment

Figure 3:
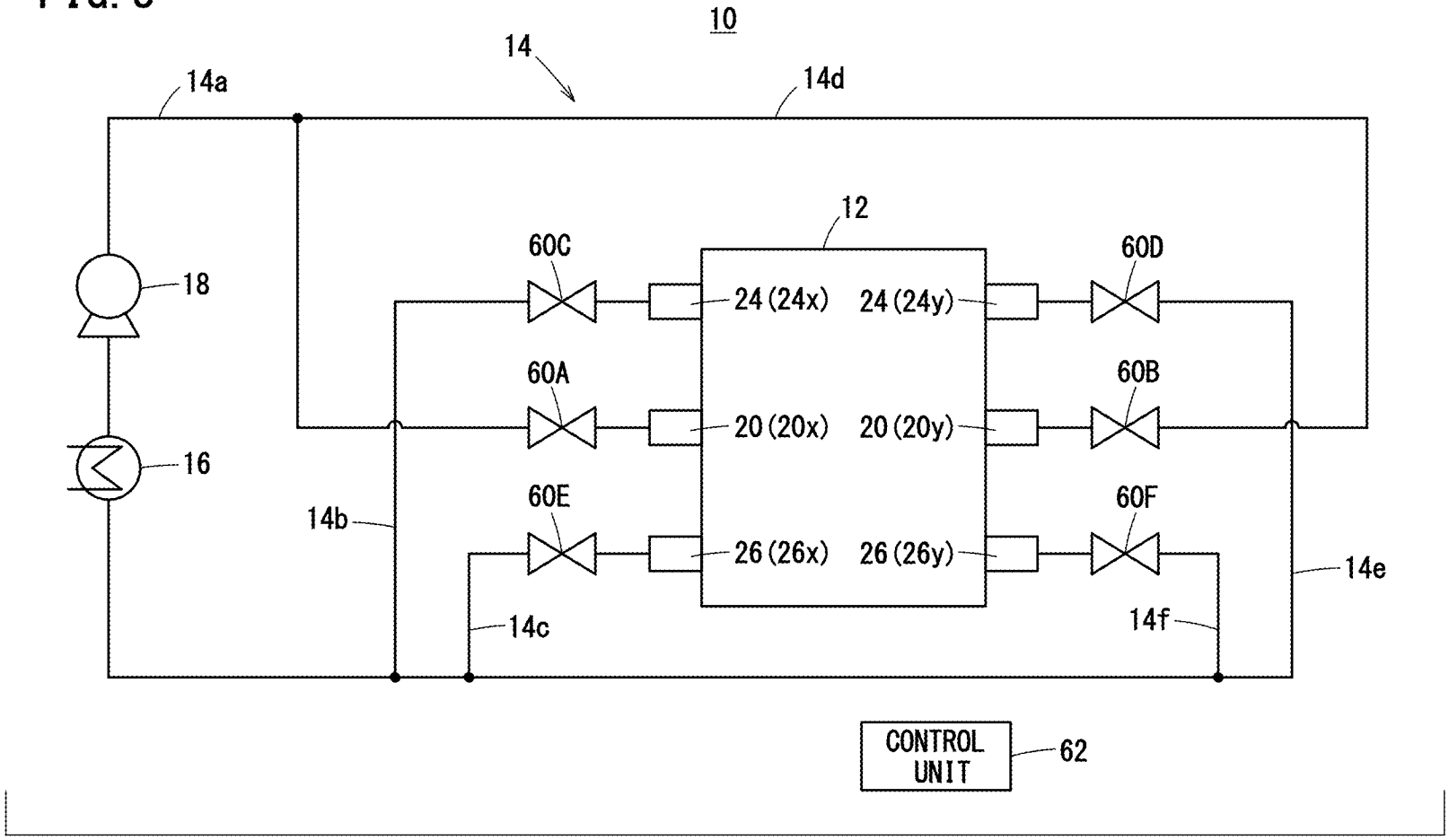
FIG. 3 is a diagram showing the water supply system according to a second embodiment.

In the second embodiment, the same components as those described in the first embodiment are denoted by the same reference numerals. In the second embodiment, the description overlapping with that of the first embodiment will be omitted. FIG. 3 is a diagram showing the water supply system 10 according to the second embodiment.

In the present embodiment, the water supply system 10 further includes a plurality of on-off valves 60A, 60B, 60C, 60D, 60E, and 60F, and a control unit 62. The plurality of on-off valves 60A, 60B, 60C, 60D, 60E, and 60F are provided in the water circulation flow path 14. The control unit 62 drives the circulation pump 18 during the operation of the electrochemical stack 12. The control unit 62 controls the plurality of on-off valves 60A, 60B, 60C, 60D, 60E, and 60F during the operation of the electrochemical stack 12.

In the present embodiment, the electrochemical stack 12 includes two water introduction units 20, two first water lead-out units 24, and two second water lead-out units 26. One of the two water introduction units 20 is referred to as a water introduction unit 20*x*, and the other of the two water introduction units 20 is referred to as a water introduction unit 20*y*. The water introduction unit 20*y* is provided at a position shifted in phase by 180° in the circumferential direction of the electrochemical stack 12 from the water introduction unit 20*x*. One of the two first water lead-out units 24 is referred to as a first water lead-out unit 24*x*, and the other of the two first water lead-out units 24 is referred to as a first water lead-out unit 24*y*. The first water lead-out unit 24*y* is provided at a position shifted in phase by 180° in the circumferential direction of the electrochemical stack 12 from the first water lead-out unit 24*x*. One of the two second water lead-out units 26 is referred to as a second water lead-out unit 26*x*, and the other of the two second water lead-out units 26 is referred to as a second water lead-out unit 26*y*. The second water lead-out unit 26*y* is provided at a position shifted in phase by 180° in the circumferential direction of the electrochemical stack 12 from the second water lead-out unit 26*x*.

In the present embodiment, the water circulation flow path 14 further includes a fourth flow path portion 14*d*, a fifth flow path portion 14*e*, and a sixth flow path portion 14*f*. The fourth flow path portion 14*d* connects the first flow path portion 14*a* and the water introduction unit 20*y*. The fifth flow path portion 14*e* connects the second flow path portion 14*b* and the first water lead-out unit 24*y*. The sixth flow path portion 14*f* connects the fifth flow path portion 14*e* and the second water lead-out unit 26*y*. The sixth flow path portion 14*f* may connect the second flow path portion 14*b* and the second water lead-out unit 26*y*. In this case, the fifth flow path portion 14*e* connects the sixth flow path portion 14*f* and the second water lead-out unit 26*y*.

The on-off valve 60A is provided in the first flow path portion 14*a* and near the water introduction unit 20*x*. The on-off valve 60B is provided in the fourth flow path portion 14*d* and near the water introduction unit 20*y*. The on-off valve 60C is provided in the second flow path portion 14*b* and near the first water lead-out unit 24*x*. The on-off valve 60D is provided in the fifth flow path portion 14*e* and near the first water lead-out unit 24*y*. The on-off valve 60E is provided in the third flow path portion 14*c* and near the second water lead-out unit 26*x*. The on-off valve 60F is provided in the sixth flow path portion 14*f* and near the second water lead-out unit 26*y*.

Figure 4:
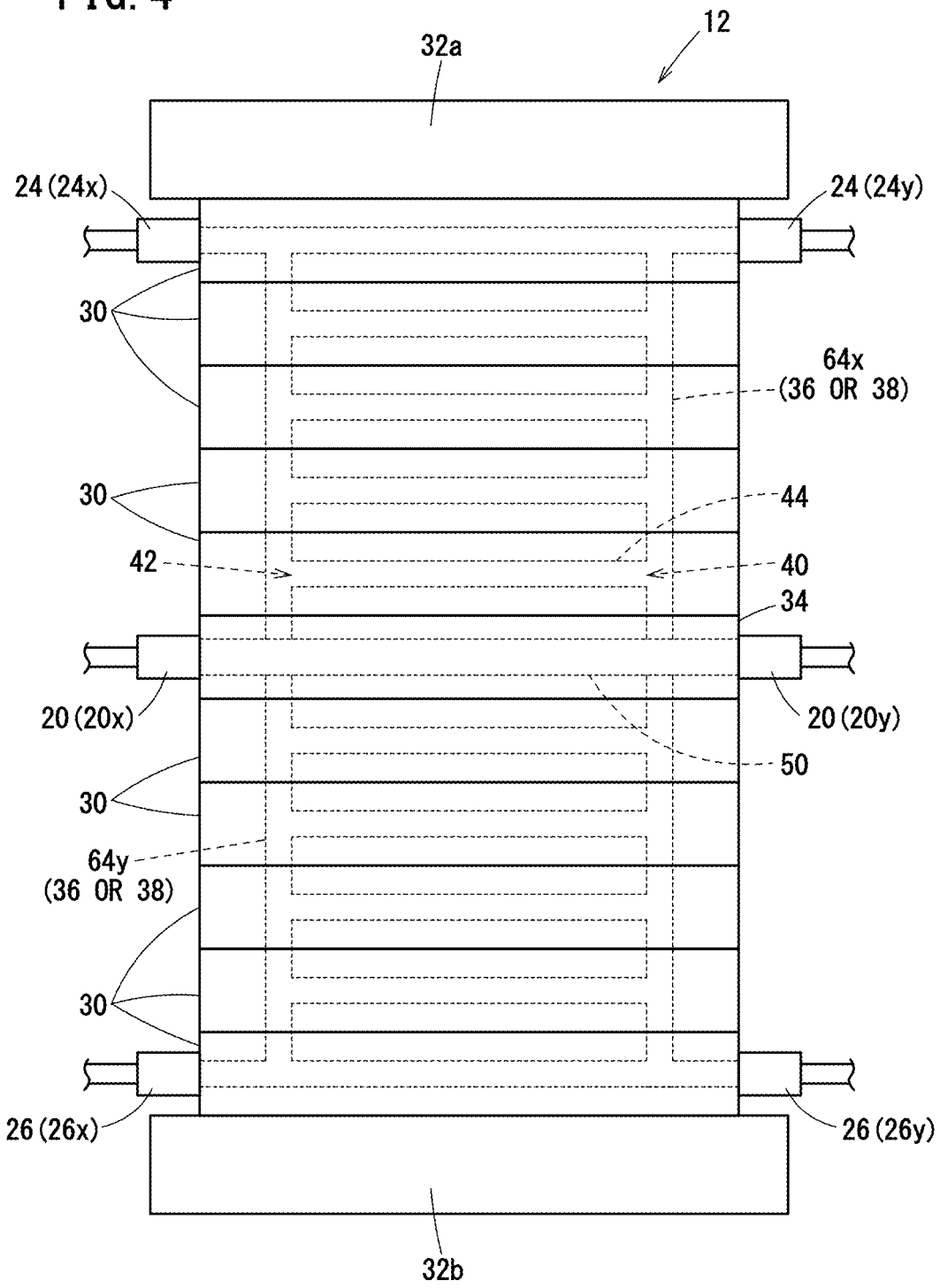
FIG. 4 is a schematic diagram showing the electrochemical stack according to the second embodiment.

FIG. 4 is a schematic diagram showing the electrochemical stack 12 according to the second embodiment. In the present embodiment, the electrochemical stack 12 includes two water introducing/lead-out communication passages 64 instead of the water introducing communication passage 36 and the water lead-out communication passage 38. One of the two water introducing/lead-out communication passages 64 is referred to as a water introducing/lead-out communication passage 64*x*, and the other of the two water introducing/lead-out communication passages 64 is referred to as a water introducing/lead-out communication passage 64*y*. The water introducing/lead-out communication passage 64*x* and the water introducing/lead-out communication passage 64*y* function as the water introducing communication passage 36 or the water lead-out communication passage 38. In a case where the water introducing/lead-out communication passage 64*x* functions as the water introducing communication passage 36, the water introducing/lead-out communication passage 64*y* functions as the water lead-out communication passage 38. Conversely, in a case where the water introducing/lead-out communication passage 64*y* functions as the water introducing communication passage 36, the water introducing/lead-out communication passage 64*x* functions as the water lead-out communication passage 38.

Figure 5:
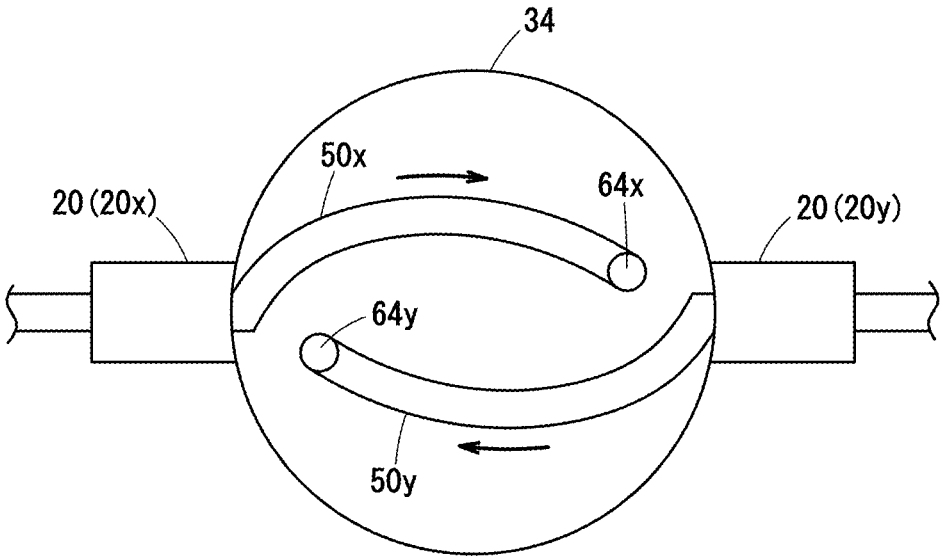
FIG. 5 is a schematic diagram showing the configuration of a water passage member.

In the present embodiment, the configuration of the water passage member 34 is different from that of the first embodiment. FIG. 5 is a schematic diagram showing the configuration of the water passage member 34. FIG. 5 shows the water passage member 34 as viewed from the front in the stacking direction of the electrochemical cells 30. The water passage member 34 shown in FIG. 5 is formed in a disk shape, but the shape is not limited thereto.

The water passage member 34 is provided with the water introduction unit 20*x*, the water introduction unit 20*y*, and two flow paths 50. One of the two flow paths 50 is referred to as a flow path 50*x*, and the other of the two flow paths 50 is referred to as a flow path 50*y*. One end of the flow path 50*x* is connected to the water introduction unit 20*x*. The other end of the flow path 50*x* is connected to the water introducing/lead-out communication passage 64*x*. One end of the flow path 50*y* is connected to the water introduction unit 20*y*. The other end of the flow path 50*y* is connected to the water introducing/lead-out communication passage 64*y*. The flow path 50*x* and the flow path 50*y* are provided separately in the water passage member 34 without communicating with each other.

In the water supply system 10 configured as described above, the control unit 62 alternately repeats a first circulation operation and a second circulation operation during the operation of the electrochemical stack 12.

Figure 6:
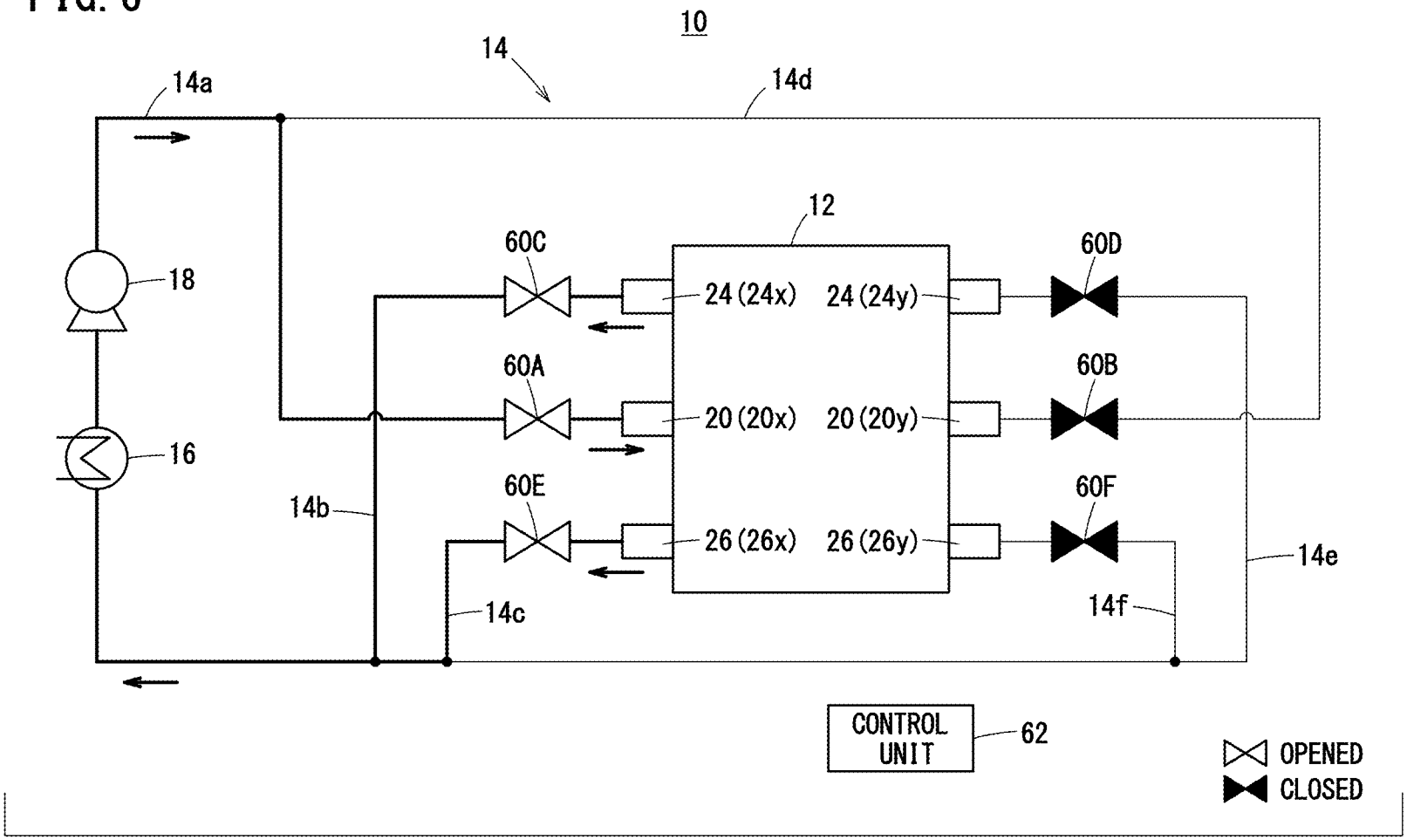
FIG. 6 is a diagram showing the flow of water in a water circulation flow path during a first circulation operation.
Figure 7:
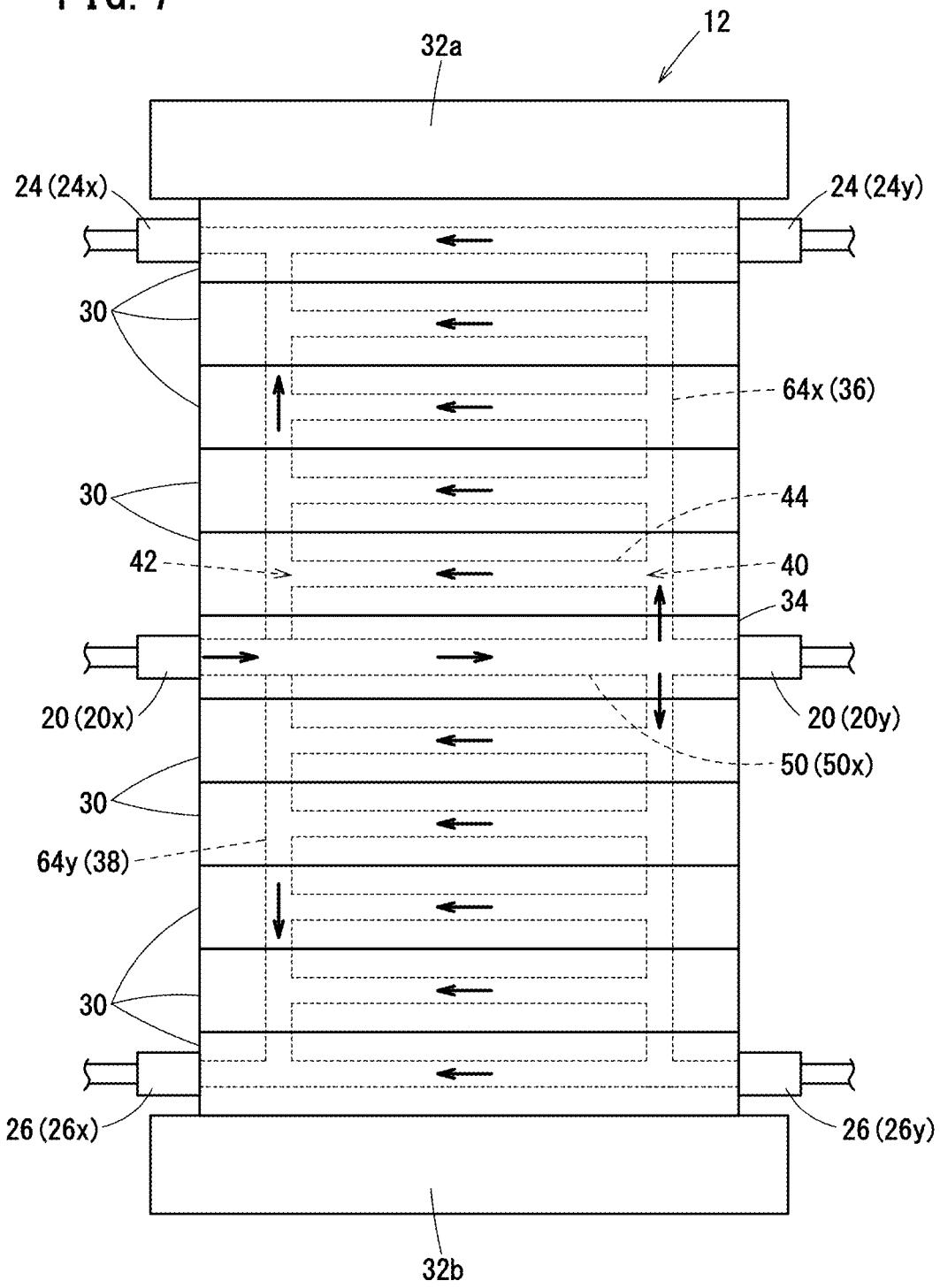
FIG. 7 is a diagram showing the flow of water in the electrochemical stack during the first circulation operation.

FIG. 6 is a diagram showing the flow of water in the water circulation flow path 14 during the first circulation operation. FIG. 7 is a diagram showing the flow of water in the electrochemical stack 12 during the first circulation operation. As shown in FIG. 6, in the first circulation operation, the control unit 62 opens the on-off valves 60A, 60C, and 60E and closes the on-off valves 60B, 60D, and 60F.

The water output from the circulation pump 18 is supplied to the water introduction unit 20*x* through the first flow path portion 14*a*. As shown in FIG. 5, the entire amount of the water supplied to the water introduction unit 20*x* flows through the flow path 50*x* of the water passage member 34. As shown in FIG. 7, the water flowing through the flow path 50*x* passes between the two electrochemical cells 30 located in the central region in the stacking direction of the electrochemical cells 30, and flows into the water introducing/lead-out communication passage 64*x*. The water introducing/lead-out communication passage 64*x* functions as the water introducing communication passage 36. Specifically, the water flowing into the water introducing/lead-out communication passage 64*x* flows in the stacking direction of the electrochemical cells 30, and reaches the first port 40 of each of the plurality of electrochemical cells 30. The water that has reached the first port 40 flows out from the second port 42 into the water introducing/lead-out communication passage 64*y* through the water supply path 44. The water introducing/lead-out communication passage 64*y* functions as the water lead-out communication passage 38. Specifically, the water that has flowed out into the water introducing/lead-out communication passage 64*y* flows in the stacking direction of the electrochemical cells 30, and reaches the first water lead-out unit 24*x* or the second water lead-out unit 26*x*. As shown in FIG. 6, the water that has reached the first water lead-out unit 24*x* is supplied to the circulation pump 18 through the second flow path portion 14*b*. On the other hand, the water that has reached the second water lead-out unit 26*x* flows into the second flow path portion 14*b* through the third flow path portion 14*c*, and is supplied to the circulation pump 18.

Figure 8:
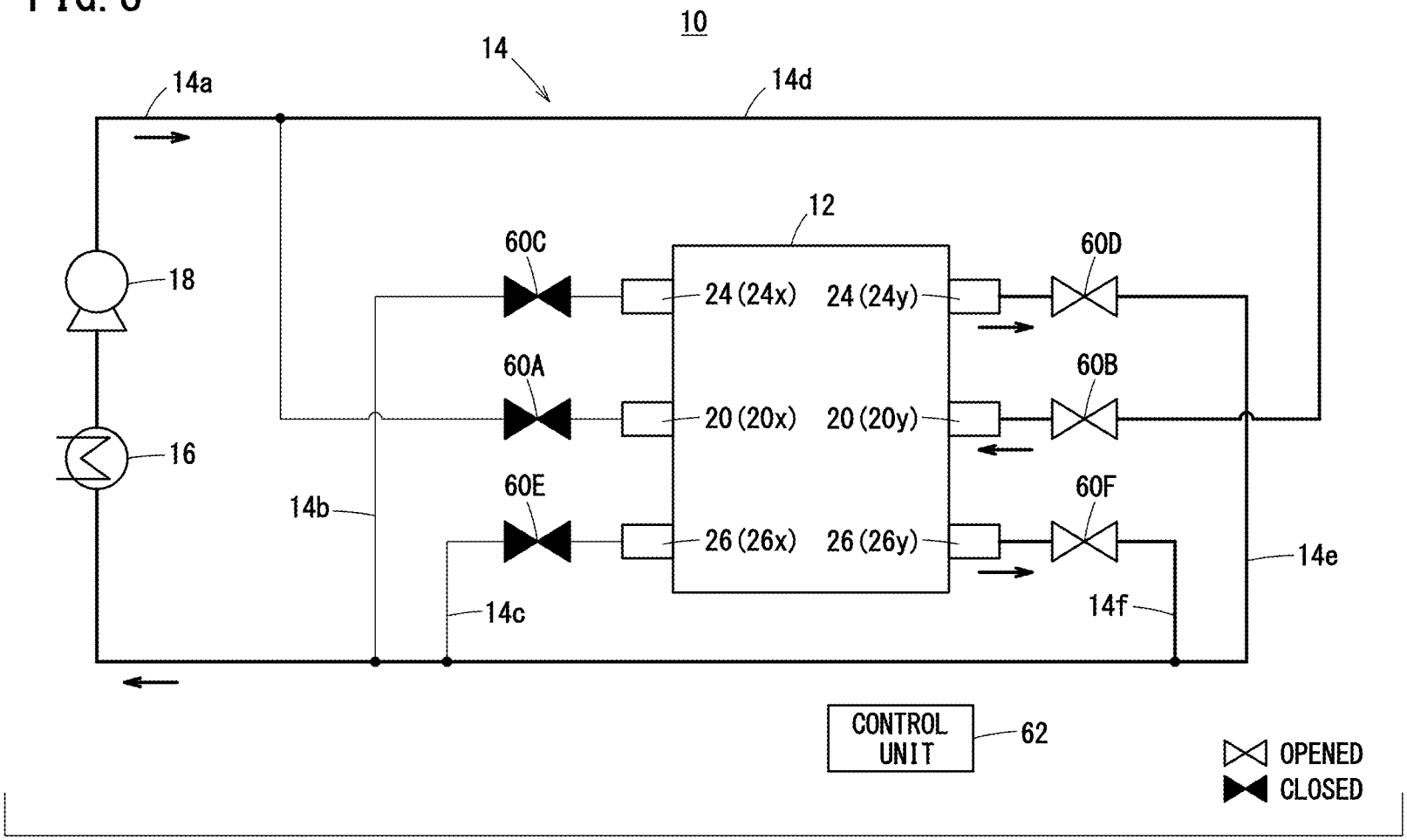
FIG. 8 is a diagram showing the flow of water in the water circulation flow path during a second circulation operation.
Figure 9:
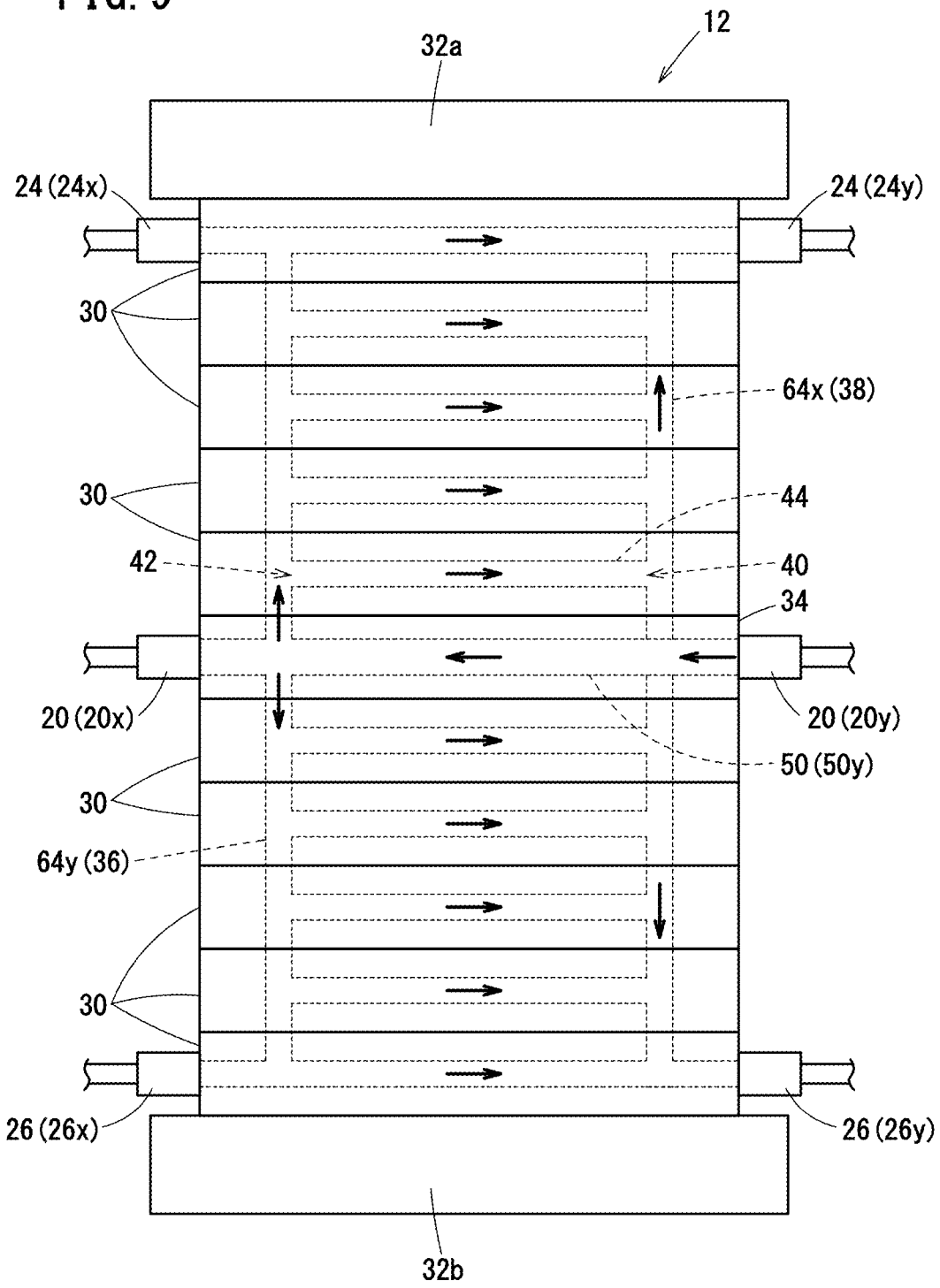
FIG. 9 is a diagram showing the flow of water in the electrochemical stack during the second circulation operation.

FIG. 8 is a diagram showing the flow of water in the water circulation flow path 14 during the second circulation operation. FIG. 9 is a diagram showing the flow of water in the electrochemical stack 12 during the second circulation operation. As shown in FIG. 8, in the second circulation operation, the control unit 62 opens the on-off valves 60B, 60D, and 60F and closes the on-off valves 60A, 60C, and 60E.

The water output from the circulation pump 18 flows into the fourth flow path portion 14*d* through the first flow path portion 14*a*, and is supplied to the water introduction unit 20*y*. As shown in FIG. 5, the entire amount of the water supplied to the water introduction unit 20*y* flows through the flow path 50*y* of the water passage member 34. As shown in FIG. 9, the water flowing through the flow path 50*y* passes between the two electrochemical cells 30 located in the central region in the stacking direction of the electrochemical cells 30, and flows into the water introducing/lead-out communication passage 64*y*. The water introducing/lead-out communication passage 64*y* functions as the water introducing communication passage 36. Specifically, the water flowing into the water introducing/lead-out communication passage 64*y* flows in the stacking direction of the electrochemical cells 30, and reaches the second port 42 of each of the plurality of electrochemical cells 30. The water that has reached the second port 42 flows out from the first port 40 into the water introducing/lead-out communication passage 64*x* through the water supply path 44. The water introducing/lead-out communication passage 64*x* functions as the water lead-out communication passage 38. Specifically, the water that has flowed out into the water introducing/lead-out communication passage 64*x* flows in the stacking direction of the electrochemical cells 30, and reaches the first water lead-out unit 24*y* or the second water lead-out unit 26*y*. As shown in FIG. 8, the water that has reached the first water lead-out unit 24*y* flows into the second flow path portion 14*b* through the fifth flow path portion 14*e*, and is supplied to the circulation pump 18. On the other hand, the water that has reached the second water lead-out unit 26*y* flows into the fifth flow path portion 14*e* through the sixth flow path portion 14*f*, then flows into the second flow path portion 14*b*, and is supplied to the circulation pump 18.

As described above, in the electrochemical stack 12 according to the present embodiment, as in the first embodiment, the water supplied from the outside can be supplied to each of the plurality of electrochemical cells 30 after the water is passed between the electrochemical cells 30 that have a relatively high temperature. As a result, it is possible to increase the degree of cooling of the electrochemical cells 30 in the central region which have a relatively high temperature.

Figure 10A:
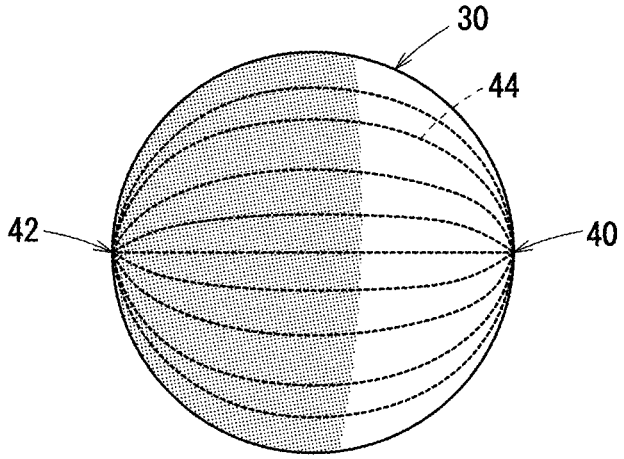
FIG. 10A is a schematic diagram showing the temperature distribution of an electrochemical cell in a case where only the first circulation operation is performed.
Figure 10B:
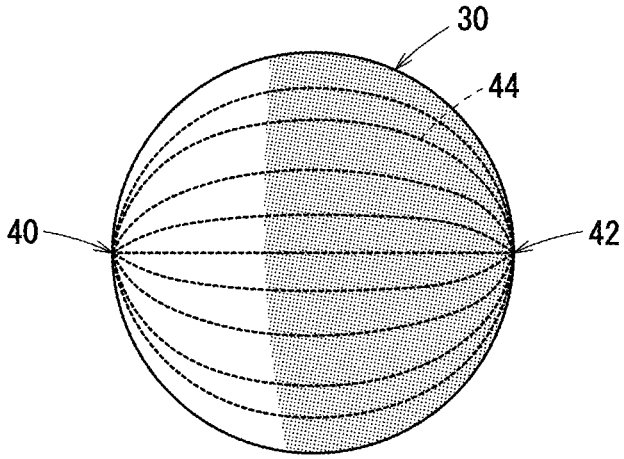
FIG. 10B is a schematic diagram showing the temperature distribution of the electrochemical cell in a case where only the second circulation operation is performed.
Figure 10C:
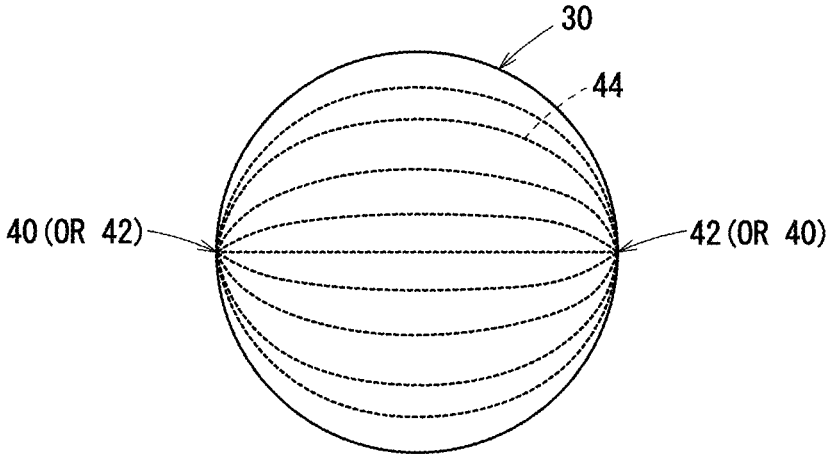
FIG. 10C is a schematic diagram showing the temperature distribution of the electrochemical cell in a case where the first circulation operation and the second circulation operation are alternately repeated.

Further, in the electrochemical stack 12 according to the present embodiment, the first circulation operation and the second circulation operation are alternately repeated during the operation of the electrochemical stack 12. In the first circulation operation, the control unit 62 adjusts the opening and closing of the plurality of on-off valves 60A to 60F so that the water flows from the first port 40 toward the second port 42 in each of the electrochemical cells 30. On the other hand, in the second circulation operation, the control unit 62 adjusts the opening and closing of the plurality of on-off valves 60A to 60F so that the water flows from the second port 42 toward the first port 40 in each of the electrochemical cells 30. Therefore, compared to a case where only the first circulation operation or the second circulation operation is performed, the difference between the upstream temperature and the downstream temperature of the water supply path 44 can be suppressed. Specifically, in a case where only the first circulation operation is performed, then as shown in FIG. 10A, the temperature in the vicinity of the second port 42 continues to be higher than the temperature in the vicinity of the first port 40. On the other hand, in a case where only the second circulation operation is performed, then as shown in FIG. 10B, the temperature in the vicinity of the first port 40 continues to be higher than the temperature in the vicinity of the second port 42. That is, the electrolysis efficiency and the progress of deterioration vary in the plane of the membrane electrode assembly. By alternately repeating the first circulation operation and the second circulation operation during the operation of the electrochemical stack 12, the difference between the upstream temperature and the downstream temperature can be suppressed as shown in FIG. 10C. As a result, it is possible to suppress variations in electrolysis efficiency and variations in the progress of deterioration in the plane of the membrane electrode assembly. It should be noted that FIG. 10A, FIG. 10B, and FIG. 10C show the temperature distribution of the electrochemical cell 30 when the electrochemical cell 30 is viewed from the stacking direction. In addition, FIG. 10A, FIG. 10B, and FIG. 10C show the case where the number of the water supply paths 44 provided in the electrochemical cell 30 is plural.

The following supplementary notes are further disclosed in relation to the above-described embodiments.

Supplementary Note 1

The electrochemical stack (12) of the present disclosure includes: the plurality of electrochemical cells (30) stacked on one another; the water introduction unit (20) configured to introduce water supplied from the outside; the water lead-out unit (22) configured to lead out the water to the outside; the water introducing communication passage (36) penetrating the plurality of electrochemical cells along the stacking direction of the electrochemical cells, and configured to guide the water to the first port (40) provided in each of the plurality of electrochemical cells; the water lead-out communication passage (38) penetrating the plurality of electrochemical cells along the stacking direction, and configured to guide, to the water lead-out unit, the water discharged from the second port (42) provided in each of the plurality of electrochemical cells; and the water passage member (34) interposed between two of the plurality of electrochemical cells, the two electrochemical cells being located in the central region in the stacking direction, wherein the water passage member is provided with the water introduction unit, and the flow path (50) through which the entire amount of the water introduced from the water introduction unit flows along the electrochemical cells and is guided to the water introducing communication passage.

Supplementary Note 2

In the electrochemical stack according to Supplementary Note 1, the first port may be located on an opposite side to the water introduction unit in a direction intersecting the stacking direction.

Supplementary Note 3

In the electrochemical stack according to Supplementary Note 1 or 2, the flow cross-sectional area of the flow path may be larger than the flow cross-sectional area of the water supply path (44) that connects the first port and the second port.

Supplementary Note 4

In the electrochemical stack according to any one of Supplementary Notes 1 to 3, the water passage member may be interposed between the electrochemical cell located at one end in the stacking direction among the plurality of electrochemical cells and the electrochemical cell located at the other end in the stacking direction among the plurality of electrochemical cells.

Supplementary Note 5

In the electrochemical stack according to any one of Supplementary Notes 1 to 4, the water lead-out unit may include the first water lead-out unit (24) provided in the electrochemical cell located at one end in the stacking direction among the plurality of electrochemical cells, and the second water lead-out unit (26) provided in the electrochemical cell located at the other end in the stacking direction among the plurality of electrochemical cells.

Supplementary Note 6

In the electrochemical stack according to any one of Supplementary Notes 1 to 5, each of the plurality of electrochemical cells may be a water electrolysis cell configured to electrolyze the water.

Although the present disclosure has been described in detail, the present disclosure is not limited to the above-described individual embodiments. Various additions, replacements, modifications, partial deletions, and the like can be made to these embodiments without departing from the gist of the present disclosure, or without departing from the essence of the present disclosure derived from the claims and equivalents thereof. Further, these embodiments can also be implemented in combination. For example, in the above-described embodiments, the order of operations and the order of processes are shown as examples, and are not limited to these. Furthermore, the same applies to a case where numerical values or mathematical expressions are used in the description of the above-described embodiments.

The invention claimed is:

1. An electrochemical stack comprising:

a plurality of electrochemical cells stacked on one another, the plurality of electrochemical cells each including a membrane electrode assembly;

a water introduction unit configured to introduce water supplied from an outside;

a water lead-out unit configured to lead out the water to the outside;

a water introducing communication passage penetrating the plurality of electrochemical cells along a stacking direction of the electrochemical cells, and configured to guide the water to a first port provided in each of the plurality of electrochemical cells;

a water lead-out communication passage penetrating the plurality of electrochemical cells along the stacking direction, and configured to guide, to the water lead-out unit, the water discharged from a second port provided in each of the plurality of electrochemical cells; and a water passage member interposed and stacked between two of the plurality of electrochemical cells, the two electrochemical cells being located in a central region in the stacking direction, wherein the water passage member is provided with the water introduction unit, and a flow path through which an entire amount of the water introduced from the water introduction unit flows along the electrochemical cells and is guided to the water introducing communication passage, and the water passage member is devoid of a membrane electrode assembly.

2. The electrochemical stack according to claim 1, wherein the first port is located on an opposite side to the water introduction unit in a direction intersecting the stacking direction.

3. The electrochemical stack according to claim 1, wherein a flow cross-sectional area of the flow path is larger than a flow cross-sectional area of a water supply path that connects the first port and the second port.

4. The electrochemical stack according to claim 1, wherein the water passage member is interposed between the electrochemical cell located at one end in the stacking direction among the plurality of electrochemical cells, and the electrochemical cell located at another end in the stacking direction among the plurality of electrochemical cells.

5. The electrochemical stack according to claim 1, wherein the water lead-out unit includes a first water lead-out unit provided in the electrochemical cell located at one end in the stacking direction among the plurality of electrochemical cells, and a second water lead-out unit provided in the electrochemical cell located at another end in the stacking direction among the plurality of electrochemical cells.

6. The electrochemical stack according to claim 1, wherein each of the plurality of electrochemical cells is a water electrolysis cell configured to electrolyze the water.

* * * * *